US008267550B2

(12) United States Patent
Wang

(10) Patent No.: US 8,267,550 B2
(45) Date of Patent: Sep. 18, 2012

(54) LED LAMP FOR EASY ASSEMBLY AND FIXATION

(75) Inventor: Chin-Wen Wang, Pingzhen (TW)

(73) Assignees: Chin-Wen Wang, Taoyuan County (TW); Leader Trend Technology Corp., Taoyuan County (TW)

( * ) Notice: Subject to any disclaimer, the term of this patent is extended or adjusted under 35 U.S.C. 154(b) by 314 days.

(21) Appl. No.: 12/797,261

(22) Filed: Jun. 9, 2010

(65) Prior Publication Data

US 2011/0304269 A1 Dec. 15, 2011

(51) Int. Cl.
*F21V 29/00* (2006.01)

(52) U.S. Cl. ..... 362/294; 362/249.02; 362/311.02; 362/373

(58) Field of Classification Search ..... 362/218, 362/249.02, 294, 311.02, 373, 545, 547
See application file for complete search history.

(56) References Cited

U.S. PATENT DOCUMENTS 8,007,143 B2 * 8/2011 Liu ..... 362/373
8,021,023 B2 * 9/2011 Liu ..... 362/294

* cited by examiner

*Primary Examiner* — Stephen F Husar
(74) *Attorney, Agent, or Firm* — Chun-Ming Shih; HDLS IPR Services

(57) ABSTRACT

A LED lamp for easy assembly and fixation includes a fixing plate, a vapor chamber, a LED module, an outer frame, and fixing elements. The fixing plate has assembling holes. The vapor chamber has a heat-releasing surface brought into thermal contact with the fixing plate and a heat-absorbing surface opposite to the heat-releasing surface. The LED module includes a circuit board and LEDs arranged on the circuit board. The outer frame is provided with through-holes corresponding to the assembling holes and an accommodating opening corresponding to the LEDs. The fixing elements penetrate the through-holes and the assembling holes respectively to assemble the outer frame with the fixing plate. With this arrangement, the vapor chamber and the LED module can be sandwiched between the outer frame and the fixing plate. Thus, the present invention can be assembled and fixed to a predetermined position with an excellent structural strength.

10 Claims, 4 Drawing Sheets

LED LAMP FOR EASY ASSEMBLY AND FIXATION

BACKGROUND OF THE INVENTION

1. Field of the Invention

The present invention relates to a LED lamp, and in particular to a LED lamp for easy assembly and fixation.

2. Description of Prior Art

Since light-emitting diodes (referred to as "LED" hereinafter) have advantages of low power consumption, long life, small volume and fast response time, they gradually replace traditional bulbs and are widely used in various lamps or light-emitting devices. In comparison to traditional incandescent bulbs, the LEDs are activated by an integrated circuit, so that those LEDs have to be disposed on a circuit board to form a LED module. A heat-dissipating module is additionally used for dissipating the heat generated by the LED module, thereby keeping the working temperature of the LED module in a suitable range.

The vapor chamber is a common thermal-conductive member, which includes a flat sealed casing, a wick structure formed in the flat sealed casing, and a working fluid filled in the flat sealed casing. The flat sealed casing is formed with a heat-absorbing surface and a heat-releasing surface opposite to the heat-absorbing surface. The heat-absorbing surface is brought into thermal contact with an electronic heat-generating element. The liquid/vapor phase change of the working liquid within the vapor chamber conducts the heat generated by the electronic heat-generating element from the heat-absorbing surface to the heat-releasing surface. Since the vapor chamber has a larger thermal-conducting area and a short travelling distance for the working fluid, the thermal-conducting efficiency of the vapor chamber is excellent. Thus, the vapor chamber is widely used for the heat dissipation of a LED lamp.

Since the flat sealed casing of the vapor chamber is not provided with fixing holes, the periphery of the vapor chamber has to be formed with a flange and fixing holes provided on the flange. In this way, the vapor chamber can be fixed to a predetermined location, which unfavorably increases the manufacturing cost of the vapor chamber. On the other hand, the positions of the fixing holes have to be changed according to different mounting conditions, which cannot conform to the requirements for mass production.

Furthermore, if the vapor chamber is to be used for assembling and fixing the LED lamp, the vapor chamber of a larger area has to be used, which inevitably increases the cost of the LED lamp because the vapor chamber is expensive. On the other hand, the thickness of the flat sealed casing of the vapor chamber is small, so that the whole structural strength of the LED lamp is not enough if the LED lamp is fixed by means of the fixing hole formed on the flange extending from the periphery of the flat sealed casing.

Therefore, it is an important issue for the present inventor to solve the above problems.

SUMMARY OF THE INVENTION

The present invention is to provide a LED lamp for easy assembly and fixation, which can be assembled and fixed to a predetermined position easily with an excellent structural strength.

The present invention provides a LED lamp for easy assembly and fixation, which includes: a fixing plate having a plurality of assembling holes; a vapor chamber having a heat-releasing surface brought into thermal contact with the fixing plate and a heat-absorbing surface opposite to the heat-releasing surface; a LED module comprising a circuit board brought into thermal contact with the heat-absorbing surface and a plurality of LEDs arranged on the circuit board; an outer frame provided with a plurality of through-holes corresponding to the assembling holes and an accommodating opening corresponding to the LEDs; and a plurality of fixing elements penetrating the through-holes and the assembling holes respectively to assemble the outer frame with the fixing plate.

In comparison with prior art, the present invention has advantages features as follows:

According to the present invention, since the fixing elements are used to assemble the outer frame and the fixing plate in such a manner that the vapor chamber and the LED module are sandwiched between the outer frame and the fixing plate, the assembly and fixation of the present invention can be performed easily.

According to the above, since the fixing plate and the outer frame are used for the assembly of the present invention, the vapor chamber needs not to be provided with flanges and fixing holes for allowing the vapor chamber to be mounted in the LED lamp. Thus, it is not necessary to use the vapor chamber of a larger area, which can reduce the cost and conform to the requirements for mass production.

According to the above, the fixing plate is used to be assembled with the outer frame. Also, the fixing plate can be used for fixing the LED lamp to a predetermined position. The structural strength of the fixing plate is significantly larger than that of the vapor chamber. Thus, using the fixing plate for the assembly and fixation of the LED lamp of the present invention can be performed easily with an excellent structural strength.

Furthermore, the heat-absorbing surface of the vapor chamber absorbs the heat generated by the LED module, and the heat-releasing surface of the vapor chamber is fully brought into thermal contact with the fixing plate to conduct the heat absorbed by the heat-absorbing surface to the fixing plate. Thus, if the fixing plate is made of metallic materials, the metallic fixing plate can enlarge the heat-releasing area of the vapor chamber to thereby increase the heat-conducting efficiency of the vapor chamber.

DETAILED DESCRIPTION OF THE INVENTION

Figure 1:
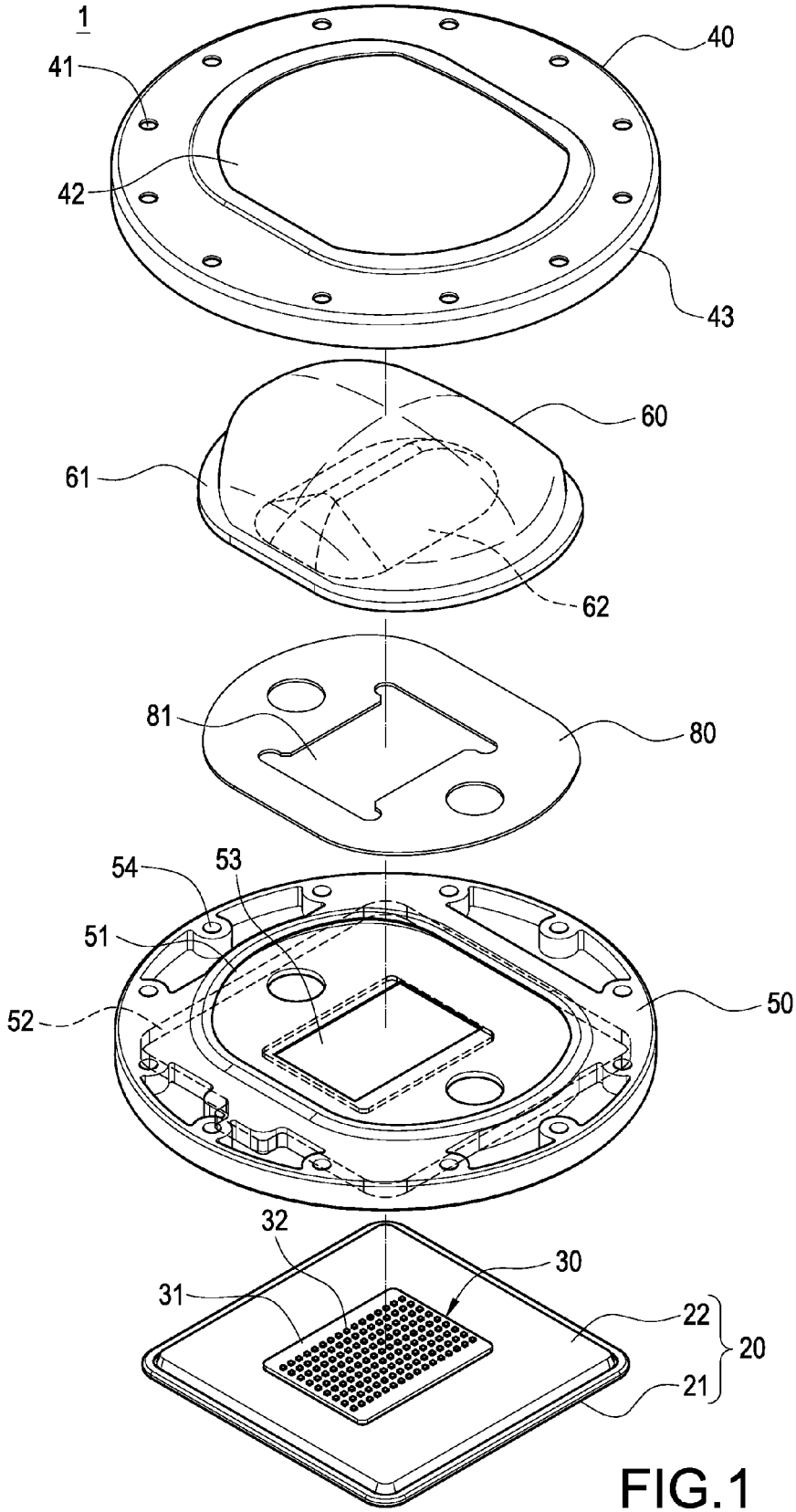
FIG. 1 is an exploded perspective view of the present invention.

The detailed description and technical contents of the present invention will become apparent with the following detailed description accompanied with related drawings. It is noteworthy to point out that the drawings is provided for the illustration purpose only, but not intended for limiting the scope of the present invention.

Please refer to FIGS. 1 to 4. The present invention provides a LED lamp 1 for easy assembly and fixation (referred to as "LED lamp 1" hereinafter). The LED lamp 1 includes a fixing plate 10, a vapor chamber 20, a LED module 30, an outer frame 40, a sealing pad 50 and a transparent cover 60.

The fixing plate 10 is used to be assembled with the outer frame 40, so that the vapor chamber 20, the LED module 30 and the sealing pad 50 can be sandwiched there between. In the present embodiment, the fixing plate 10 is formed into a square shape and provided with a plurality of assembling holes 11. These assembling holes 11 are screw holes for allowing the fixing elements 70 (such as screws shown in FIG. 2) to penetrate there through. Of course, the assembling holes 11 may be through-holes and the fixing elements 70 may be rivets or the combination of bolts and nuts. Further, four corners of the fixing plate 10 are provided with a fixing hole 12 respectively, whereby the fixing plate 10 can be fixed to a predetermined position or an object.

Furthermore, a heat-absorbing surface 22 of the vapor chamber 20 absorbs the heat generated by the LED module 30, and a heat-releasing surface 21 of the vapor chamber 20 is fully brought into thermal contact with the fixing plate 10 to conduct the heat absorbed by the heat-absorbing surface 22 to the fixing plate 10. Thus, if the fixing plate 10 is made of metallic materials (such as copper or aluminum), the metallic fixing plate 10 can enlarge the heat-releasing area of the vapor chamber 20 to thereby increase the heat-conducting efficiency of the vapor chamber 20.

However, the fixing plate 10 is not limited to be made of metallic materials. If the weight of the LED lamp 1 is to be decreased, the fixing plate 10 can be made of reinforced plastic or other suitable materials.

The vapor chamber 20 has a heat-releasing surface 21 brought into thermal contact with the fixing plate 10 and a heat-absorbing surface 22 opposite to the heat-releasing surface 21. The heat-absorbing surface 22 is brought into thermal contact with the LED module 30. In the present embodiment, the vapor chamber 30 is formed into a square shape. Since the internal structure of the vapor chamber 20 is conventional and not the characteristic of the present invention. The description thereof is omitted for simplicity.

The LED module 30 comprises a circuit board 31 brought into thermal contact with the heat-absorbing surface 31 and a plurality of LEDs 32 arranged on the circuit board 31. In the present embodiment, the circuit board 31 is formed into a rectangular shape. The LEDs 32 are arranged on the circuit board 31 in a matrix and emit light when being supplied with electricity.

The outer frame 40 may be made of plastic or metallic materials. The outer frame 40 is provided with a plurality of through-holes 41 corresponding to the assembling holes 11 of the fixing plate 10 and an accommodating opening 42 corresponding to the LEDs 32. In the embodiment shown in FIG. 1, the outer frame 40 is formed into a circular shape and is provided in the center thereof with an oval accommodating opening 42. The through-holes 41 are provided to surround the accommodating opening 42. The edge of the outer frame 40 is folded to form a flange 43 as shown in FIG. 4, thereby forming an accommodating space for accommodating the vapor chamber 20, the LED module 30 and the sealing pad 50 therein.

The sealing pad 50 is accommodated in the outer frame 40. The bottom surface of the sealing pad 50 is formed with an annular slot 51 corresponding to the accommodating opening 42 of the outer frame 40. The top surface of the sealing pad 50 is provided with a trough 52 for allowing the vapor chamber 2 to be disposed therein. The center of the trough 52 is provided with an opening 53 for supporting the LED module 30. The periphery of the trough 52 is provided with a plurality of penetrations 54 corresponding to the assembling holes 11 and the through-holes 41. In the present embodiment, the sealing pad 50 is formed into a circular shape corresponding to the outer frame 40 and accommodated in the accommodating space formed by the flange 43 of the outer frame 40. The sealing pad 50 is made of plastic or rubber in order to prevent external moistures from entering the LED lamp 1. It should be noted that the thickness of the sealing pad 50 is substantially equal to the height of the flange 43 of the outer frame 40. The position and profile of the annular slot 51 substantially correspond to those of the accommodating opening 42 of the outer frame 40. In this way, a flange 61 of the transparent cover 60 can be engaged with the annular slot 51 and supported in the accommodating opening 42. The sealing pad 50 is provided with the trough 52 for allowing the vapor chamber 20 to be disposed therein. The center of the trough 52 is provided with the opening 53 whose profile corresponds to that of the circuit board 31 of the LED module 30 to be rectangular. However, the area of the opening 53 is smaller than that of the circuit board 31. Thus, the LEDs 32 can be exposed to the opening 52, but the circuit board 31 cannot pass through the opening 53, thereby supporting the LED module 30. The number, position and dimension of the penetrations 54 of the sealing pad 50 correspond to those of the through-holes 41 of the outer frame 40 and the assembling holes 11 of the fixing plate 10, whereby the fixing elements 70 (screws shown in FIG. 2) can pass there through. Of course, it is apparent for those skilled in this art that the sealing pad 50 of a smaller area may be used and no perforations 54 are provided. By this structure, the fixing plate 10 can be tightly assembled with the outer frame 40 to generating a sealing effect.

Figure 2:
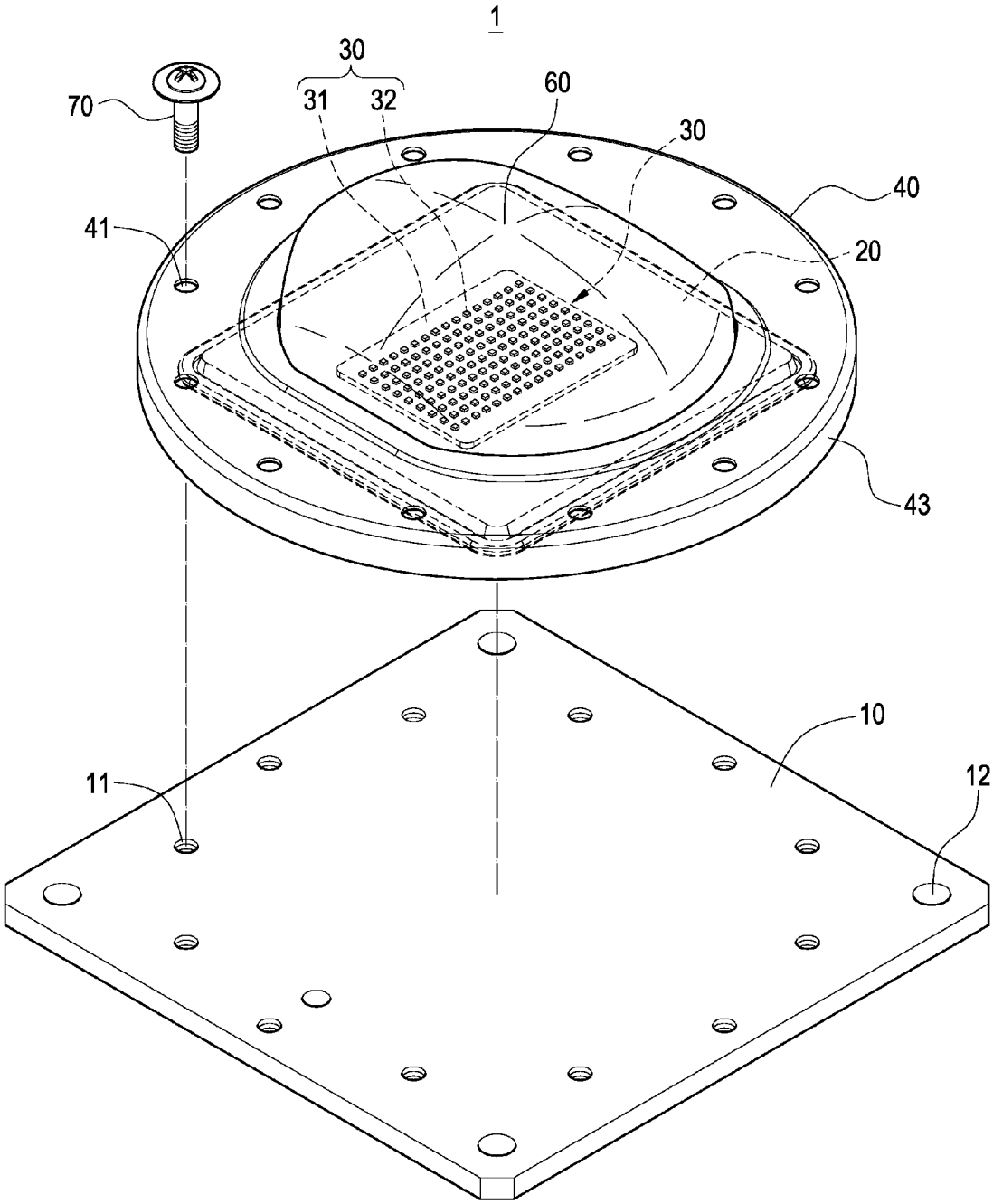
FIG. 2 is another exploded perspective view of the present invention showing that fixing elements are used to assemble a fixing plate and an outer frame.
Figure 3:
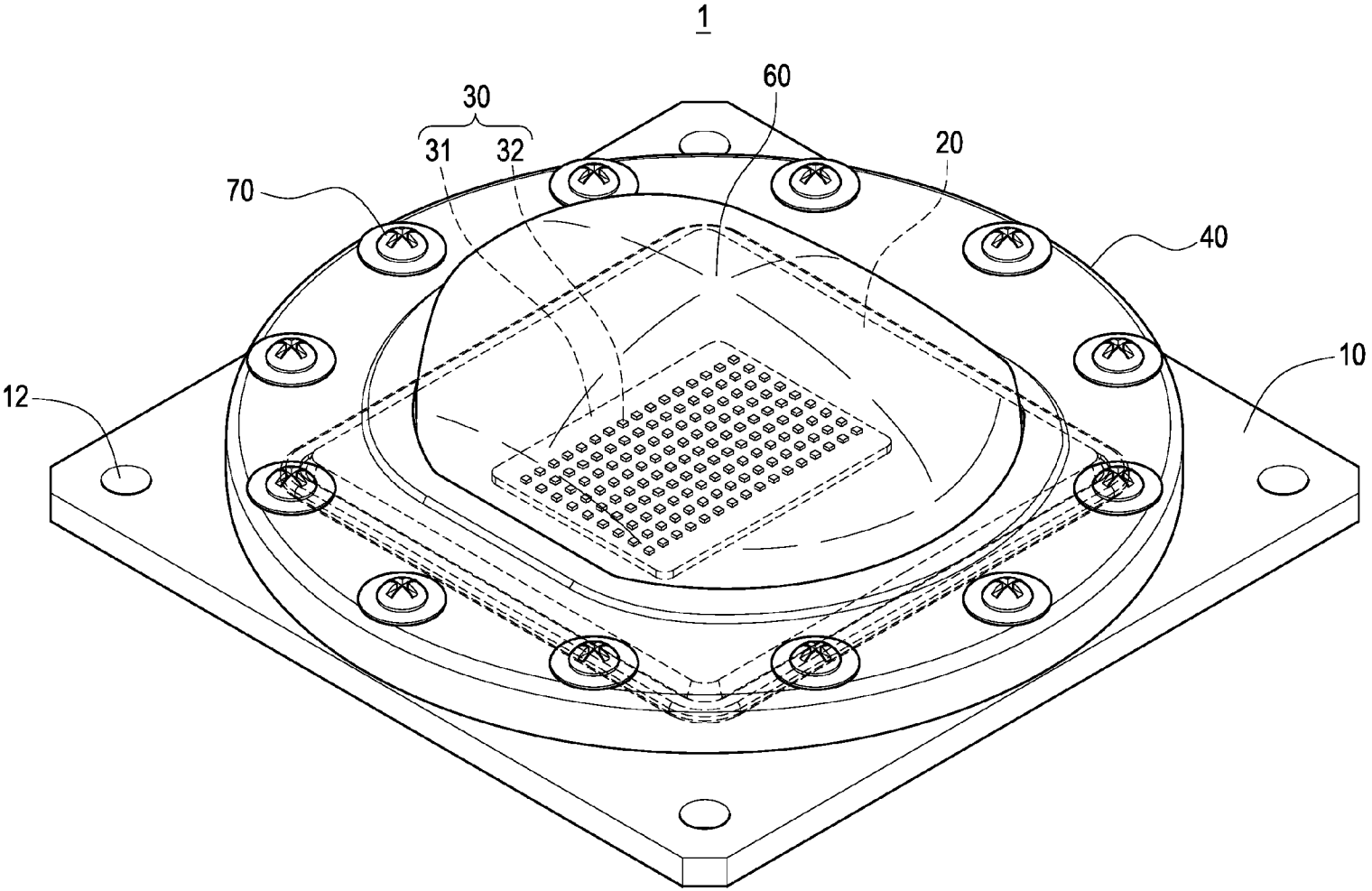
FIG. 3 is an assembled perspective view of the present invention.

Please refer to FIGS. 2 and 3. The fixing elements 70 pass through the through-holes 41 of the outer frame 40 and the assembling holes 11 of the fixing plate 10, thereby fixing the outer frame 40 and the fixing plate 10. In this way, the vapor chamber 20, the LED module 30 and the sealing pad 50 can be sandwiched between the outer frame 40 and the fixing plate 10.

Figure 4:
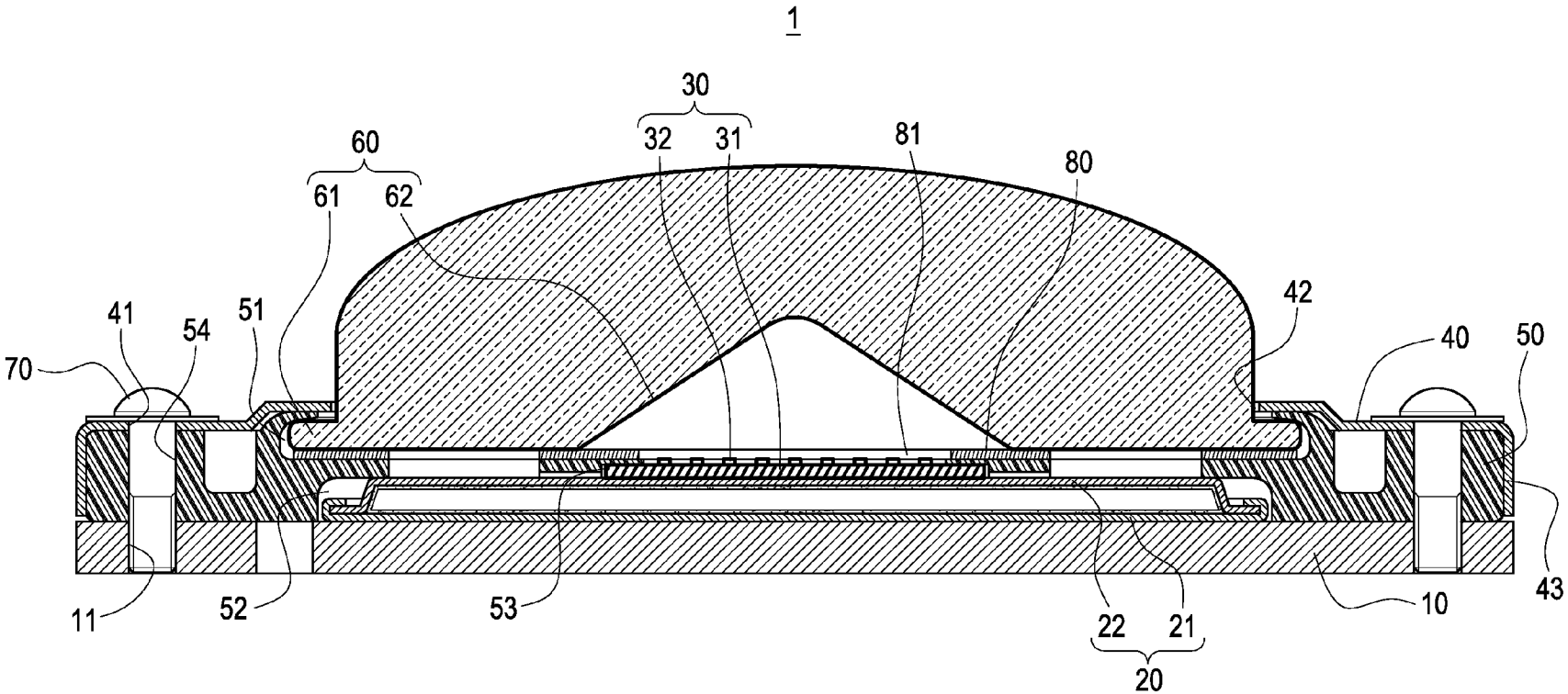
FIG. 4 is an assembled cross-sectional view of the present invention.

As shown in FIGS. 1 and 4, in order to prevent external moistures or dust from entering the LED lamp 1, the transparent cover 60 is mounted in the periphery of the accommodating opening 42 of the outer frame 40. The transparent cover 60 is made of transparent plastic or resin. The periphery of the transparent cover 60 has the flange 61 engaged with the annular slot 51 of the sealing pad 50 and a lens portion 62 adjacent to the LEDs 32. The lens portion 62 is configured to reflect the light emitted by the LEDs 32 to the outside, thereby generating a wider range of light projection.

As shown in FIGS. 1 and 4, a pressing plate 80 may be selectively provided between the sealing pad 50 and the transparent cover 60 for pressing the LED module 30 onto the sealing pad 50 and preventing the sealing pad 50 from suffering deformation. In this way, the LED module 30 can be prevented from falling through the opening 53 of the sealing pad 50. As shown in FIG. 1, the profile of the pressing plate 80 is substantially equal to that of the annular slot 51 of the sealing pad 50. The center of the pressing plate 80 is provided with an open hole 81 corresponding to the opening 53 of the sealing pad 50. The profile and dimension of the open hole 81 correspond to those of the opening 53, thereby preventing the circuit board 31 of the LED module 30 from falling through the open hole 81.

In comparison with prior art, the present invention has advantages features as follows:

According to the present invention, since the fixing elements 70 are used to assemble the outer frame 40 and the fixing plate 10 in such a manner that the vapor chamber 20 and the LED module 30 are sandwiched between the outer frame 40 and the fixing plate 10, the assembly and fixation of the present invention can be performed easily.

According to the above, since the fixing plate 10 and the outer frame 40 are used for the assembly of the present invention, the vapor chamber 20 needs not to be provided with a flange and fixing holes for allowing the vapor chamber 20 to be mounted in the LED lamp 1. Thus, it is not necessary to use the vapor chamber 20 of a larger area, which can reduce the cost and conform to the requirements for mass production.

According to the above, the fixing plate 10 is used to be assembled with the outer frame 40. Also, the fixing plate 10 can be used for fixing the LED lamp 1 to a predetermined position. The structural strength of the fixing plate 10 is significantly larger than that of the vapor chamber 20. Thus, using the fixing plate 10 for the assembly and fixation of the LED lamp 1 of the present invention can be performed easily with an excellent structural strength.

Although the present invention has been described with reference to the foregoing preferred embodiment, it will be understood that the invention is not limited to the details thereof. Various equivalent variations and modifications can still occur to those skilled in this art in view of the teachings of the present invention. Thus, all such variations and equivalent modifications are also embraced within the scope of the invention as defined in the appended claims.

What is claimed is:

1. A LED lamp for easy assembly and fixation, comprising:
a fixing plate having a plurality of assembling holes;
a vapor chamber having a heat-releasing surface brought into thermal contact with the fixing plate and a heat-absorbing surface opposite to the heat-releasing surface;
a LED module comprising a circuit board brought into thermal contact with the heat-absorbing surface and a plurality of LEDs arranged on the circuit board;
an outer frame provided with a plurality of through-holes corresponding to the assembling holes and an accommodating opening corresponding to the LEDs; and
a plurality of fixing elements penetrating the through-holes and the assembling holes respectively to assemble the outer frame with the fixing plate.

2. The LED lamp for easy assembly and fixation according to claim 1, further comprising a sealing pad accommodated between the outer frame and the fixing plate, the vapor chamber and the LED module being sandwiched between the outer frame and the fixing plate, one surface of the sealing pad being formed with an annular slot corresponding to the accommodating opening, the other surface of the sealing pad having a trough for allowing the vapor chamber to be disposed therein, the center of the trough being provided with an opening for supporting the LED module.

3. The LED lamp for easy assembly and fixation according to claim 2, wherein the sealing pad is provided with a plurality of perforations corresponding to the through-holes and the assembling holes.

4. The LED lamp for easy assembly and fixation according to claim 3, further comprising a transparent cover mounted in the accommodating opening of the outer frame, the periphery of the transparent cover being formed with a flange engaged with the annular slot.

5. The LED lamp for easy assembly and fixation according to claim 4, wherein one surface of the transparent cover facing the LED module is formed with a lens portion.

6. The LED lamp for easy assembly and fixation according to claim 5, further comprising a pressing plate disposed between the sealing pad and the transparent cover, the periphery of the pressing plate being inserted into the annular slot of the sealing pad, the pressing plate having an open hole, the position and profile of the open hole corresponding to those of the opening.

7. The LED lamp for easy assembly and fixation according to claim 6, wherein the sealing pad is made of plastic or rubber, the opening is smaller than the circuit board in area, and the LEDs are exposed to the opening.

8. The LED lamp for easy assembly and fixation according to claim 7, wherein the fixing plate is made of metallic materials, and four corners of the fixing plate are provided with a plurality of fixing holes.

9. The LED lamp for easy assembly and fixation according to claim 8, wherein the assembling holes are screw holes, and the fixing elements are screws.

10. The LED lamp for easy assembly and fixation according to claim 8, wherein the assembling holes are through-holes, and the fixing elements are rivets.

* * * * *